US005116192A

United States Patent [19]

Usa

[11] Patent Number: 5,116,192

[45] Date of Patent: May 26, 1992

[54] TONE GENERATION DEVICE CAPABLE OF GENERATING A SPECIAL TONE

[75] Inventor: Satoshi Usa, Hamamatsu, Japan

[73] Assignee: Yamaha Corporation, Hamamatsu, Japan

[21] Appl. No.: 525,113

[22] Filed: May 17, 1990

[30] Foreign Application Priority Data

May 18, 1989 [JP] Japan ..... 1-125406

[51] Int. Cl.[5] ..... G10H 1/057; G10H 1/08; G10H 1/18; G10H 1/46

[52] U.S. Cl. ..... 84/653; 84/659; 84/663; 84/665

[58] Field of Search ..... 84/605, 609-620, 84/622-638, 649-669, 678-690, 691-717, DIG. 4, DIG. 5, DIG. 26

[56] References Cited

U.S. PATENT DOCUMENTS 4,148,239 4/1979 Oya et al. ..... 84/605
4,399,731 8/1983 Aoki ..... 84/609
4,947,724 8/1990 Hirano et al. ..... 84/DIG. 4

*Primary Examiner*—Stanley J. Witkowski

*Attorney, Agent, or Firm*—Spensley Horn Jubas & Lubitz

[57] ABSTRACT

There are provided a tone signal generation circuit capable of selectively generating either a normal tone signal corresponding to a selected tone color or a special tone signal corresponding to the same selected tone color but having a characteristic which is different from that of the normal tone signal, and a tone selection circuit selecting whether the normal tone signal is to be generated or the special tone signal is to be generated in this tone signal generation circuit. A tone signal having a characteristic of a tone generated by a misplay, for example, is used as the special tone signal. In case a tone is generated by depression of a key, the normal tone signal is selectively generated in most cases but the special tone signal may be selectively generated from time to time. By doing so, a tone of a misplay is occasionally generated thereby giving the impression of naturalness as if a natural musical instrument were being played. In case the generation of the special tone signal has been selected, the special tone signal may be temporarily generated and then tone generation may be switched to generation of the normal tone signal. In performing such switching, a crossfade control of the evelope level may be applied.

11 Claims, 3 Drawing Sheets

CONTROL DATA FOR A SINGLE TONE COLOR

| | |
|---|---|
| NORMAL WAVEFORM DESIG. | NSL |
| SPECIAL WAVEFORM 1 DESIG. | $SSL_1$ |
| SPECIAL WAVEFORM 2 DESIG. | $SSL_2$ |
| SPECIAL WAVEFORM 3 DESIG. | $SSL_3$ |
| REFERENCE DATA 1 | $RD_1$ |
| REFERENCE DATA 2 | $RD_2$ |
| REFERENCE DATA 3 | $RD_3$ |
| CROSSFADE TIMING DATA | TMD |

SELECTION SIGNAL GENERATION CIRCUIT 24

TONE GENERATION DEVICE CAPABLE OF GENERATING A SPECIAL TONE

BACKGROUND OF THE INVENTION

This invention relates to a tone generation device employed in an electronic musical instrument or the like device and, more particularly, to a tone generation device simulating generation of a tone in a natural musical instrument such as a string instrument and a wind instrument. More particularly, the tone generation device is capable of generating a tone which closely resembles the tone generated by a natural musical instrument, by generating once a tone signal simulating a special tone such as an erroneous tone generated by a misplay in a plurality of key depressing operations.

An unexpected tone is sometimes erroneously generated by a misplay during performance of a rubbed string instrument such as violin. Such tone generated by a misplay occurs with a certain probability however accomplished the performer may be. Such erroneous tone gives little offence to the ear and rather is effective for giving the listener the impression that a natural musical instrument is being played. If, however, the tone generated by a misplay only is extracted and heard, this tone may be a very unpleasant one. This is because the tone is generated in a weak vibration mode of its fundamental tone.

Known in the art is an electronic musical instrument capable of generating a tone having a tone color of violin. In this electronic musical instrument, by depressing a desired key on a keyboard, a tone signal having a tone pitch corresponding to the depressed key and having a tone color of violin is generated.

In the prior art electronic musical instrument, tones generated are always of a clear tone color of violin regardless of the number of times of key depression, and a tone of a misplay generated in playing the violin as a natural musical instrument is not generated. Thus, the prior art electronic musical instrument gives the impression that tones produced by the instrument lack naturalness.

SUMMARY OF THE INVENTION

It is an object of the invention to provide a tone generation device capable of generating, in addition to normal tone signals, a tone signal simulating a special tone such as a tone generated by a misplay from time to time.

For achieving this object, the tone generation device according to the invention comprises tone color selection means, tone signal generation means capable of selectively generating either a normal tone signal corresponding to a tone color selected by said tone color selection means or a special tone signal corresponding to the same selected tone color but exhibiting a characteristic which is different from that of the normal tone signal, and tone selection means for selecting whether the normal tone signal is to be generated or the special tone signal is to be generated by said tone signal generation means.

According to this construction, either a normal tone signal corresponding to a selected tone color or a special tone signal corresponding to the same selected tone color but exhibiting a characteristic which is different from the characteristic of the normal tone signal can be selectively generated. If, accordingly, a tone signal having, for example, a characteristic of a tone generated by a misplay is employed as the special tone signal, the tone of a misplay can be generated in addition to the normal tones.

The selection of whether a normal tone signal is to be generated or a special tone signal is to be generated can be made at random. The selection may also be made at random in accordance with a predetermined probability. The selection may also be made at a predetermined ratio in accordance with a predetermined sequence. The selection may also be made by operation of a manual switch. For giving impression of naturalness in the performance, the probability of generating a special tone signal is preferably lower than the probability of generating a normal tone signal, such that a tone of a misplay is generated from time to time during the performance of normal tones.

In case generation of a normal tone signal has been selected, the normal tone may be generated from the start of tone generation to the end thereof but, in case generation of a special tone has been selected, a special tone signal may be temporarily generated and thereafter tone generation may be switched to generation of a normal tone signal. By doing so, a tone of a misplay can be temporarily generated and otherwise a normal tone can be generated. In such switching of tone generation from the special tone signal to the normal tone signal, a crossfade control may be applied in such a manner that the envelope level of the special tone signal is gradually decreased while the envelope level of the normal tone signal is gradually increased. Such control is preferable because the switching of tone generation can be made quite smoothly.

According to another aspect of the invention, the tone generation device comprises tone pitch designation means for designating a tone pitch of a tone to be generated, control data generation means for generating first tone generation control data necessary for generating a normal tone having the designated tone pitch and a predetermined tone color and second tone generation control data necessary for generating a special tone having a tone characteristic which is different from that of the normal tone, tone selection means for selecting one of the normal tone and the special tone each time a tone pitch is designated by said tone pitch designation means so that the special tone is selected at a certain probability or definitely at least once a plurality of tone pitches are designated, and tone generation means for generating, when the normal tone has been selected by said tone selection means, the normal tone signal having the tone pitch designated by said tone pitch designation means and the predetermined tone color in response to the first tone generation control data from said control data generation means and generating, when the special tone has been selected by said tone selection means, the special tone signal having the tone characteristic corresponding to the special tone in response to the second tone generation control data from said control data generation means and the tone pitch designation by said tone pitch designation means.

According to this construction, by designating tone pitches in sequence by the tone pitch designation means, normal tone signals mixed with an occasional special tone signal are generated in correspondence to several tone pitches designated. If, therefore, a tone of a misplay is employed as the special tone signal, a tone signal simulating a tone of a misplay is generated from time to time whereby a tone generation giving the impression of naturalness can be realized.

BRIEF DESCRIPTION OF THE DRAWINGS

In the accompanying drawings.

DESCRIPTION OF PREFERRED EMBODIMENTS

Figure 1:
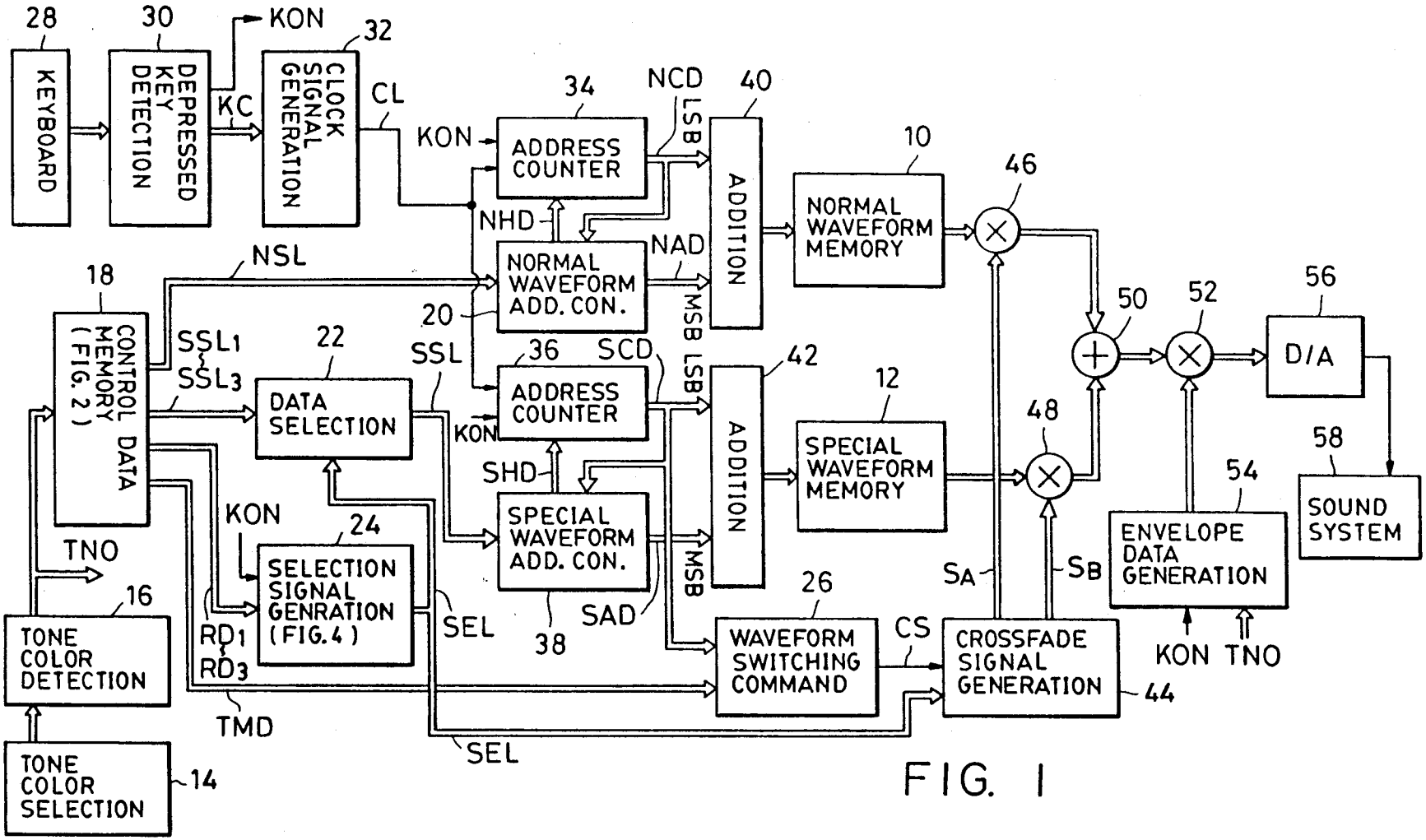
FIG. 1 is a block diagram showing an electronic musical instrument including an embodiment of the tone signal generation device according to the invention.

FIG. 1 shows the circuit construction of an electronic musical instrument having an embodiment of the tone generation circuit according to the invention. Each signal line shown as a broad arrow line represents plural signal lines or indicates that the signal line transmits data of plural bits.

A normal waveform memory 10 stores waveform data for each of musical instruments such as a violin, trumpet, piano etc. Each normal waveform data is prepared by sampling, with a predetermined sampling period, a waveform of an attack portion and a waveform of one cycle of subsequent sustain portion of a musical instrument waveform obtained by actually playing a musical instrument corresponding to each tone color and analog-to-digital converting its amplitude value at each sample.

A special waveform memory 12 stores three kinds (i.e., first to third) special waveform data for each tone color of musical instruments such as a violin, trumpet etc. Each special waveform data is prepared by sampling and analog-to-digital converting, in the same manner as in the preparation of normal waveform data, a waveform of an attack portion and a waveform of one cycle of subsequent sustain portionof a tone of misplay obtained by actually playing a musical instrument corresponding to each tone color.

As to tone colors of musical instruments such as a piano from which a tone of a misplay is seldom generated, storage of misplay tone waveform data in the memory 12 may be omitted, and another special waveform data substituting for such misplay tone waveform data may be stored in the memory 12.

A tone color selection operator group 14 includes tone color selection operators (e.g., switches) each of which corresponds to one of plural musical instruments such as violin, trumpet, piano etc.

A tone color detection circuit 16 detects a tone color selected by the tone color selection operator group 14 and thereupon supplies tone color number data TNO corresponding to the tone color selection operator to a data memory 18.

Figures 2, 3:
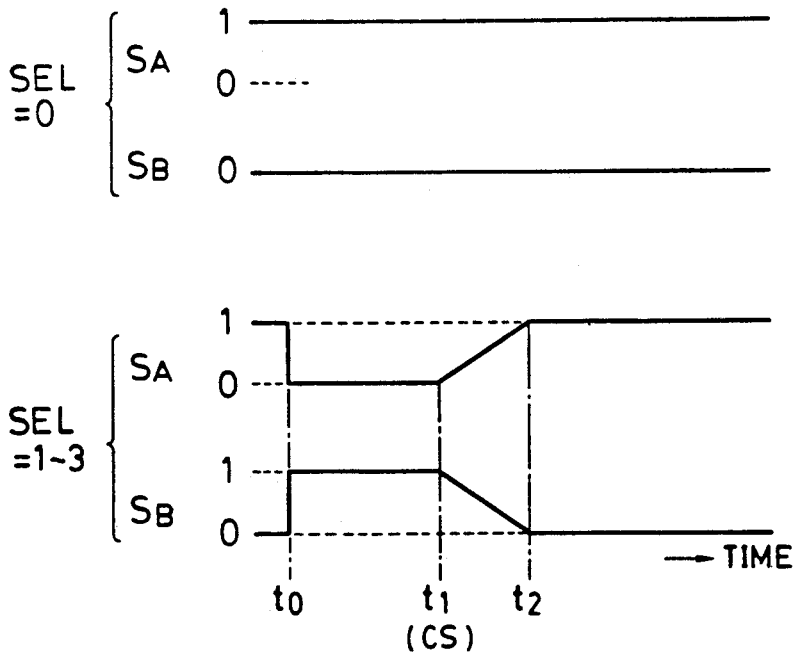
FIG. 2 is a format diagram showing control data for one tone color in a control data memory.
FIG. 3 is a waveform diagram showing a crossfade signal.

A control data memory 18 stores control data as shown in FIG. 2 for each tone color of the respective musical instruments which can be selected by the tone color selection operator group 14.

In FIG. 2, NSL represents normal waveform designation data, SSL1-SSL3 special waveforms 1 through 3 designation data, RD1-RD3 first through third reference data and TMD crossfade timing data, respectively.

The normal waveform designation data NSL relates to normal waveform data of the corresponding tone color stored in the memory 10 and includes first and second head address data and end address data. The first head address data represents the head address for a waveform of an attack portion of normal waveform data, the second head address data represents the head address for a waveform of one cycle of a sustain portion following the attack portion and the end address data represents the end address of the waveform of one cycle of the sustain portion.

The special waveforms 1 through 3 designation data SSL1-SSL3 relates to the first through third special waveform data of the corresponding tone color stored in the memory 12. Each special waveform designation data includes the first and second head address data and end address data of the related special waveform data. The first head address data represents the head address of a waveform of an attack portion of the related special waveform data, the second head address data represents the head address of a waveform of one cycle of a sustain portion following the attack portion and the end address data represents the end address of the waveform of one cycle of the sustain portion.

The first through third reference data RD1-RD3 for selecting a waveform are used for determining four numerical value ranges in randomly selecting the normal waveform and one of the special waveforms 1-3.

The crossfade timing data TMD is used for determining a crossfade timing, i.e., a timing for switching, in case one of the special waveforms has been selected, tone generation from one based on the selected special waveform to another one based on the normal waveform. This data TMD consists of data representing a predetermined value (one of 1, 2, . . . N) corresponding to the number of times of reading the waveform of one cycle of the sustain portion.

In a case where special waveform data is not stored in the memory 12 as in the case of the piano tone color described before, data other than NSL in the memory 18 are all zero.

Upon supply of tone color number data TNO corresponding to a selected tone color from the tone color detection circuit 16 to the control data memory 18 by the tone color selection operation, control data corresponding to the selected tone color is read from the memory 18. Of the read out control data, the normal waveform designation data NSL is supplied to a normal waveform address control circuit 20, the special waveforms 1 through 3 designation data SSL1-SSL3 are supplied to a data selection circuit 22, the first through third reference data RD1-RD3 for waveform selection are supplied to a selection signal generation circuit 24 and the crossfade timing data TMD is supplied to a waveform switching command circuit 26.

A keyboard 28 has a number of keys. When one of the keys has been depressed, a depressed key detection circuit 30 generates a key-on signal KON representing that there is a depressed key and a key code signal KC corresponding to the depressed key. This key code signal KC is supplied to a clock signal generation circuit 32 which thereupon generates a clock signal CL for waveform reading having a frequency corresponding to the tone pitch of the depressed key. This clock signal CL is supplied with the key-on signal KON to address counters 34 and 36. The address counters 34 and 36 are reset at the timing of rising of the key-on signal KON and thereafter starts counting of the clock signal CL.

The selection signal generation circuit 24 generates, each time the key-on signal KON is generated, a 2-bit signal SEL for randomly selecting the normal waveform and one of the special waveforms 1-3 in response to the first through third reference data RD1-RD3. The relation between the value of the signal SEL and the selected waveform is as follows:

| SEL value | Selected waveform |
|---|---|
| 0 | normal waveform |
| 1 | special waveform 1 |
| 2 | special waveform 2 |
| 3 | special waveform 3 |

The selected signal SEL from the selection signal generation circuit 24 is supplied to the data selection circuit 22 which thereupon selects one of the special waveforms 1 through 3 designation data SSL1-SSL3 and supplies the selected data to a special waveform address control circuit 38 as waveform designation data SSL.

An operation for reading waveform data from the memory 10 will now be described. The address control circuit 20 supplies the first head address data of the normal waveform designation data NSL to an addition circuit 40 as higher order address data NAD. The address counter 34 supplies its count output to the addition circuit 40 as lower order address data NCD.

The addition circuit 40 supplies address data which is a combination of the higher order address data NAD and the lower order address data NCD to the memory 10. In the memory 10, a normal waveform (e.g., a normal waveform of a violin tone color) to be read out is designated in response to the higher order address data NAD, and waveform data from the attack portion to the end of one cycle of the sustain portion of this normal waveform is sequentially read out in accordance with change in the numerical value of the lower order address data NCD. The address control circuit 20 compares the lower order address data NCD (i.e., count output) from the address counter 34 with the end address data of the normal waveform designation data NSL and, if the two values coincide with each other, presets the second head address data NHD of the normal waveform designation data NSL in the address counter 34. The counter 34 therefore counts the clock signal CL from the head address of one cycle of the sustain portion again after having reached the end address at the end of one cycle of the sustain portion and repeats this operation thereafter. Accordingly, after the waveform data from the attack portion to the end of one cycle of the sustain portion of the designated normal waveform has been read from the memory 10, the waveform data for one cycle of the sustain portion is repeatedly read from the memory 10.

On the other hand, waveform data is read from the memory 12 in the following manner. The address control circuit 38 supplies the first head address data of the waveform designation data SSL to an addition circuit 42 as higher order address data SAD. The address counter 36 supplies its count output to the addition circuit 42 as lower order address data SCD.

The addition circuit 42 supplies address data which is a combination of the higher order address data SAD and the lower order address data SCD to the memory 12. In the memory 12, a special waveform (e.g., a waveform of a misplay tone of a violin tone color) to be read out is designated in response to the higher order address data SAD and waveform data from the attack portion to the end of one cycle of the sustain portion of the special waveform is sequentially read out in accordance with change in the numerical value of the lower address data SCD. The address control circuit 38 compares the lower order address data SCD (i.e., count output) from the address counter 36 with the end address data of the waveform designation data SSL and, if the two values coincide with each other, presets the second head address data SHD of the waveform designation data SSL in the address counter 36. The counter 36 therefore counts the clock signal SL from the head address of one cycle of the sustain portion again after having reached the end address at the end of one cycle of the sustain portion and repeats this operation thereafter. Accordingly, after the waveform data from the attack portion to the end of one cycle of the sustain portion has been read from the memory 12, the waveform data of one cycle of the sustain portion is repeatedly read from the memory 12.

When a particular tone color has been selected, the selection signal generation circuit 24 supplies the selection signal SEL for random selection each time the key-on signal has been generated and, accordingly, the data selection circuit 22 selects randomly one of the special waveform 1 through 3 designation data SSL1-SSL3 in response to the selection signal SEL and supplies the selected data as the waveform selection data SSL. The special waveform read from the memory 12 therefore may be the same or may not be the same as the preceding read out waveform at each key depression. If the selected tone color is changed, the normal waveform corresponding to the new tone color is read from the memory 10 and any one of the special waveforms 1-3 corresponding to the new tone color is read from the memory 12.

The waveform switching command circuit 26 includes a maximum value detection circuit which receives the lower address data SCD (i.e., count output) from the address counter 36, detects its maximum value and generates a pulse upon this detection, a counter which counts pulses from the maximum value detection circuit and a comparison circuit which compares the count of this counter with the value of the crossfade timing data TMD and generates a waveform switching command signal CS upon coincidence of the two values. If, accordingly, the value of the data TMD is for example 3, the waveform switching command signal SC is generated when the waveform of one cycle of the sustain portion of the special waveform has been read out three times.

A crossfade signal generation circuit 44 normally outputs a value 1 as a signal SA and a value 0 as a signal SB as shown in FIG. 3 including a case where the selection signal SEL=0. If the signal SEL is any one of the values 1-3, the crossfade signal generation circuit 44 outputs, as shown in FIG. 3 for example, a value 0 as the signal SA and a value 1 as the signal SB at the timing of t0. Thereafter, upon generation of the waveform switching signal CS from the circuit 26 at the timing of t1, the signal SA changes gradually toward 1 and the signal SB changes gradually toward 0 and the signal SA reaches 1 and the signal SB reaches 0 at the timing of t2 upon lapse of a predetermined length of time (e.g., 0.5 second).

The signals SA and SB are supplied respectively to multipliers 46 and 48 so that these signals are multiplied with the outputs of the memories 10 and 12. Outputs of these multipliers 46 and 48 are supplied to an adder 50. Accordingly, what is supplied to the adder 50 when SEL=0 is only the output of the memory 10. When SEL is one of 1-3, the output of the memory 12 only is supplied to the adder 50 during the period of t0-t1, and what is supplied to the adder 50 is gradually changed from the output of the memory 12 to the output of the memory 10 during the period of t1-t2, and the output of the memory 10 only is supplied to the adder 50 after t2. As a result, when the special waveform has been selected, a tone such as a misplayed tone is generated on the basis of the special waveform data during the period of t0-t1 which is determined in accordance with the value of the crossfade timing data TMD, but tone generation is switched gradually to a tone based on the normal waveform data after the lapse of this period and finally the tone based on the normal waveform data only is generated. By applying crossfading from the special waveform to the normal waveform, the memory capacity of the memory 12 can be saved.

The waveform data from the adder 50 is supplied to a multiplier 52. An envelope generation circuit 54 selects envelope data corresponding to the selected tone color in response to the tone color number data TNO from the tone color detection circuit 16 and supplies this envelope data to the multiplier 52 in response to the key-on signal KON. The multiplier 52 therefore multiplies the waveform data by the envelope data and thereby imparts an amplitude envelope to the tone waveform.

The tone waveform data from the multiplier 52 is supplied to a digital-to-analog converter 56 where it is converted to an analog tone signal. The analog tone signal from the digital-to-analog converter 56 is supplied to a sound system 58 and propagated as a tone.

Figure 4:
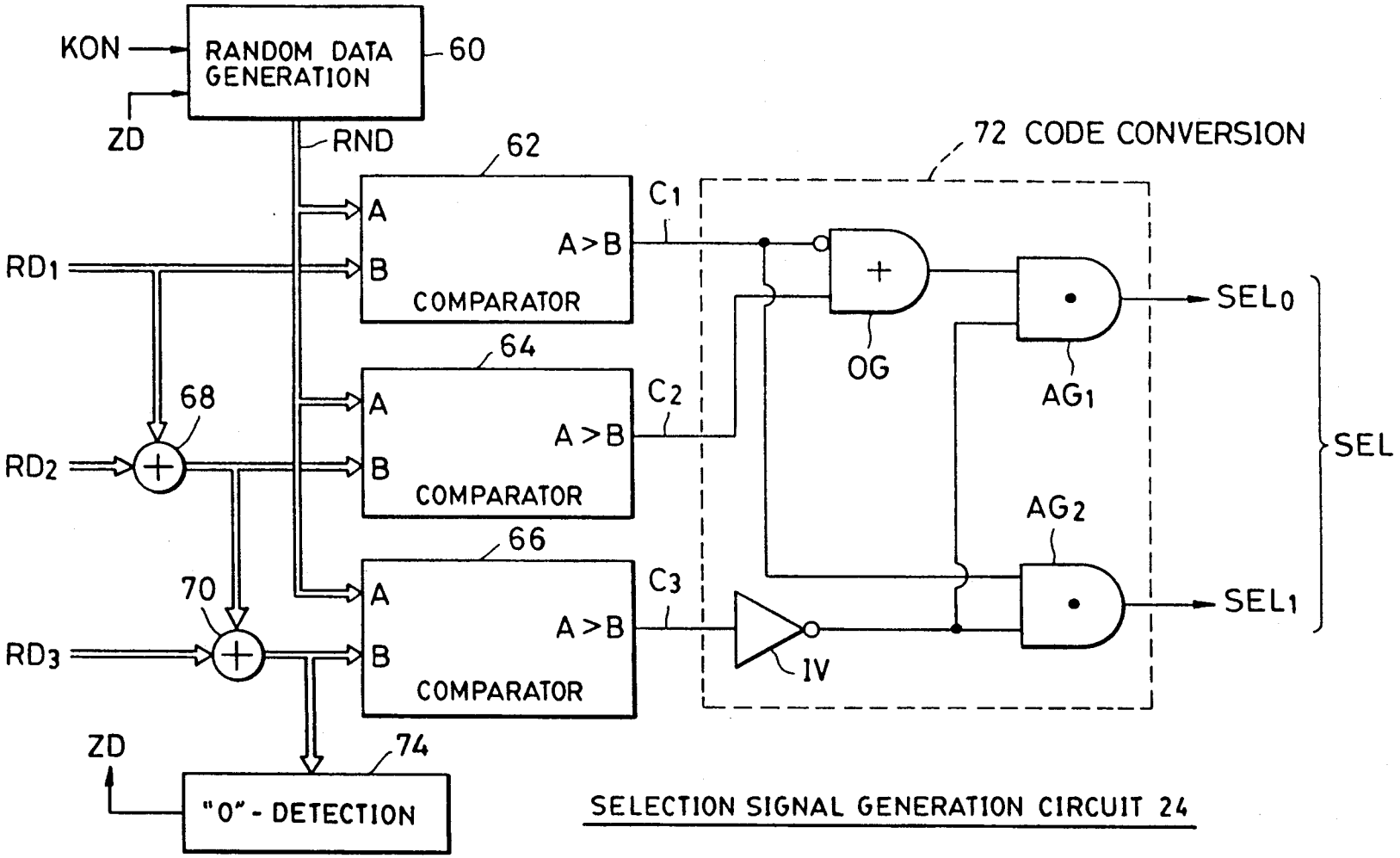
FIG. 4 is a circuit diagram showing an example of a selection signal generation circuit.

FIG. 4 shows an example of construction of the selection signal generation circuit 24.

A random data generation circuit 60 generates 8-bit random data RND which assumes randomly any one of the values 0-255 in response to the key-on signal KON. This random data RND is applied as an input A to comparators 62, 64 and 66.

As an input B of the comparator 62, the first reference data RD1 for waveform selection is supplied. The comprator 62 compares the inputs A and B, and its output C1 will be 0 if A is equal to or smaller than B and will be 1 if A is larger than B.

As an input B of the comparator 64, data obtained by adding the first and second reference data RD1 and RD2 for waveform selection by an adder 68 (the value of the data being assumed to be as RD1+RD2) is supplied. The comparator 64 compares the inputs A and B, and its output C2 will be 0 if A is equal to or smaller than RD1+RD2 and will be 1 if A is larger than RD1+RD2.

As an input B of the comparator 66, data obtained by adding the first through third reference data RD1-RD3 for waveform selection together by an adder 70 (the value of the data being assumed to be as RD1+RD2+RD3) is supplied. The comparator 66 compares the inputs A and B, and its output C3 will be 0 if A is equal to or smaller than RD1+RD2+RD3 and will be 1 if A is larger than RD1+RD2+RD3.

If, for example, RD1 is 31, RD2 is 32 and RD3 is 32 and RND is the value of the data RND, the following four ranges of numerical values are determined, and the outputs C1-C3 for the respective ranges and probability of appearance of the numerical values in these ranges become as follows. It is assumed that probability of appearance of each value in 0-255 is 1/256.

| Numerical value range | C1 | C2 | C3 | Probability of appearance |
|---|---|---|---|---|
| (1) RND ≦ 31 | 0 | 0 | 0 | $\frac{1}{8}$ |
| (2) 32 ≦ RND ≦ 63 | 1 | 0 | 0 | $\frac{1}{8}$ |
| (3) 64 ≦ RND ≦ 95 | 1 | 1 | 0 | $\frac{1}{8}$ |
| (4) 96 ≦ RND | 1 | 1 | 1 | $\frac{5}{8}$ |

A code conversion circuit 72 includes an OR gate OG, an inverter IV and AND gates AG1 and AG2 and converts the 3-bit comparator outputs C1-C3 to 2-bit signals SEL0 and SEL1 as the selection signal SEL in the following relation of correspondence:

| C1 | C2 | C3 | SEL1 | SEL2 | SEL value |
|---|---|---|---|---|---|
| 0 | 0 | 0 | 0 | 1 | 1 |
| 1 | 0 | 0 | 1 | 0 | 2 |
| 1 | 1 | 0 | 1 | 1 | 3 |
| 1 | 1 | 1 | 0 | 0 | 0 |

A 0-detection circuit 74 detects that the output value of the adder 70 is 0 and thereupon generates a detection signal ZD. This signal ZD is supplied to the random data generation circuit 60 to prohibit the data RND from assuming the value 0. In the case that, as in the case of the piano tone color described before, data other than NSL in the memory 18 are all 0, RD1-RD3 are all 0 and, therefore, C1-C3 become 0 0 0 if RND is 0 and 1 1 1 if RND is 1 or larger so that the SEL value becomes 1 when RND is 0, resulting in the inconvenience that the output of the memory 10 is not supplied from the multiplier 46. Accordingly, by prohibiting RND from becoming 0 upon detection that RD1-RD3 are all 0, such inconvenience is eliminated and tone generation based on the normal waveform can be performed smoothly.

Since, in the above described embodiment, the normal waveform and one of the special waveforms are randomly selected, a particular special waveform may or may not be selected once for eight times of generation of the key-on signals even if the probability of selection of the particular special waveform is for example $\frac{1}{8}$.

In another embodiment of the invention, therefore, a particular special waveform is always selected once for eight times of generation of the key-on signals. For this purpose, a counter for counting the key-on signals may, for example, be provided and a particular special waveform may be selected each time the count of this counter has reached a predetermined value.

The invention is not limited to the above described embodiments but is applicable in various modifications. For example, the following modifications may be made.

In the above described embodiment, tone generation means of a waveform memory type has been described. The invention is not limited to this but tone generation means of a harmonics synthesis type or a frequency modulation type may be employed.

In the above embodiment, the example in which crossfading is made from the special waveform to the normal waveform is described. Alternatively, crossfading may be made from the normal waveform to the special waveform. Alternatively further, a full waveform from the start of attack to the end of decay may be stored and read out with respect to a desired special waveform without performing crossfading.

In the above embodiment, the example in which the normal tone and the special tone are generated with the same pitch by using the same reading speed for both of the normal waveform and the special waveform has been described. Alternatively, the pitch of the special tone may be shifted slightly or octavewise from the pitch of the normal tone.

In view of the fact that the probability of misplay increases as the musical instrument is played strongly, the value of the waveform selection reference data may be variably controlled by, for example, detecting the strength of key touch.

The length of duration of sounding of a tone based on the special waveform may be varied by variably controlling the value of the crossfade timing data in accordance with, for example, the strength of key touch.

In the above embodiment, the example of monophonic musical instruments has been described. The invention however is applicable also to polyphonic musical instruments. Further, the invention is applicable not only to the above described example of a keyboard type musical instrument but also to an automatic musical instrument performing an automatic performance on the basis of performance data supplied from a memory or the like device.

As described above, according to the invention, a special tone such as a tone of a misplay can be occasionally generated in addition to a normal tone so that a tone giving the impression of naturalness by closely simulating a tone of a natural musical instrument such as a string or wind musical instrument can be generated.

What is claimed is:

1. A tone generation device comprising:

tone pitch designation means for designating a tone pitch of a tone to be generated;

control data generation means for generating first tone generation control data necessary for generating a normal tone having the designated tone pitch and a predetermined tone color and second tone generation control data necessary for generating a special tone having at least one of the special tone's tone color, tone pitch and tone volume different from that of the normal tone;

tone selection means for selecting one of the normal tone and the special tone each time a tone pitch is designated by said tone pitch designation means so that the special tone is selected at least once each time a plurality of tone pitches are designated; and tone generation means for generating, when the normal tone has been selected by said tone selection means, a normal tone signal having the tone pitch designated by said tone pitch designation means and the predetermined tone color in response to the first tone generation control data from said control data generation means, and for generating, when the special tone has been selected by said tone selection means, a special tone signal in response to the second tone generation control data from said control data generation means and the tone pitch designation by said tone pitch designation means.

2. A tone generation device as defined in claim 1 wherein said control data generation means generates a plurality of said second tone generation control data in correspondence to a plurality of special tones each having at least one of tone color, tone pitch and tone volume different from the other special tones, and wherein said tone selection means selects, each time tone pitch designation data is generated by said tone pitch designation means, either the normal tone or one of the special tones and selects one of the special tones at least once each time a plurality of tone pitch designation data are generated, and wherein said tone generation means generates, when one of the special tones has been selected by said tone selection means, the special tone signal corresponding to the selected special tone in response to the second tone generation control data corresponding to the selected special tone and tone pitch designation data from said tone pitch designation means.

3. A tone generation device capable of generating tone colors of a plurality of natural musical instruments, comprising:

tone color selection means for selecting a tone color of one of the plurality of natural musical instruments;

tone designation means for designating tone generation;

tone selection means for selecting, upon each tone designation by the tone designation means, either a normal tone signal corresponding to a tone color selected by the tone color selection means or a special tone signal corresponding to the normal tone signal but having at least one of the special tone signal's tone color, tone pitch, and tone volume different from that of the normal tone signal, the normal tone signal being selected more often than the special tone signal; and tone signal generation means for generating either the normal tone signal or the special tone signal in accordance with the tone signal selected by the tone selection means.

4. A tone generation device as defined in claim 3 wherein said tone selection means performs the selection of whether the normal tone signal is to be generated or the special tone signal is to be generated, at random in such a manner that the special tone signal is generated at least once each time a plurality of tone designations take place.

5. A tone generation device as defined in claim 3 wherein said tone selection means performs the selection of whether the normal tone signal is to be generated or the special tone signal is to be generated, in accordance with a predetermined sequence.

6. A tone generation device as defined in claim 3 wherein said tone selection means performs the selection of whether the normal tone signal is to be generated or the special tone signal is to be generated, by operation of a manual switch.

7. A tone generation device as defined in claim 3 further comprising switching means for generating, when generation of the special tone signal has been selected by said tone selection means, the special tone signal temporarily and then switching tone generation to generation of the normal tone signal.

8. A tone generation device as defined in claim 7 wherein said switching means applies, in switching the tone generation from the special tone signal to the normal tone signal, a crossfade control in such a manner that an envelope level of the special tone signal is gradually decreased while an envelope level of the normal tone signal is gradually increased.

9. A tone generation device as defined in claim 3 wherein the special tone signal simulates a misplay of the normal tone signal, and said tone selection means occasionally selects the special tone signal and otherwise selects the normal tone signal.

10. A tone generation device as defined in claim 4, wherein the number of times the normal tone signal is generated is larger than the number of times the special tone signal is generated in this sequence.

11. A method of simulating the tone generation of one of a plurality of natural musical instruments in an electronic musical instrument, comprising the steps of:

selecting a tone color of one of the plurality of natural musical instruments;

providing a normal tone signal for the selected tone color;

providing a special tone signal corresponding to the normal tone signal but having at least one of the special tone signal's tone color, tone pitch, and tone volume different from that of the normal tone signal;

designating the tone to be generated;

selecting, upon the tone designation, either the normal tone signal or the special tone signal to be generated; and generating either the normal tone signal or the special tone signal in accordance with the tone signal selected.

* * * * *